United States Patent [19]

Kindig

[11] Patent Number: 4,824,441

[45] Date of Patent: Apr. 25, 1989

[54] METHOD AND COMPOSITION FOR DECREASING EMISSIONS OF SULFUR OXIDES AND NITROGEN OXIDES

[75] Inventor: James K. Kindig, Boulder, Colo.

[73] Assignee: Genesis Research Corporation, Carefree, Ariz.

[21] Appl. No.: 126,409

[22] Filed: Nov. 30, 1987

[51] Int. Cl.[4] ..... C10L 10/00; F23B 7/00

[52] U.S. Cl. ..... 44/604; 44/641; 110/347; 431/4

[58] Field of Search ..... 44/1 R, 1 SR, 26, 603, 44/641, 604, 905; 110/344, 347; 431/4

[56] References Cited

U.S. PATENT DOCUMENTS

| | | | |
|---|---|---|---|
| 2,876,084 | 3/1959 | Leggin | 44/26 |
| 3,640,016 | 2/1972 | Lee et al. | 44/1 SR |
| 3,756,791 | 9/1973 | Mancke | 44/1 SR |
| 4,173,454 | 11/1979 | Heins | 44/1 SR |
| 4,192,652 | 3/1980 | Smith | 44/26 |
| 4,230,460 | 10/1980 | Maust, Jr. | 44/1 SR |
| 4,316,813 | 2/1982 | Voss | 110/342 |
| 4,387,653 | 6/1983 | Voss | 110/342 |
| 4,388,877 | 6/1983 | Molayem et al. | 44/1 SR |
| 4,494,962 | 1/1985 | Christie et al. | 44/15 D |

FOREIGN PATENT DOCUMENTS

| | | | |
|---|---|---|---|
| 2816891 | 1/1979 | Fed. Rep. of Germany | 44/1 SR |
| 3015710 | 10/1981 | Fed. Rep. of Germany | 44/1 SR |

OTHER PUBLICATIONS

Maloney, Sulfur Capture in Cold Flames, AIChE Symposium Series, vol. 76, (1980).

Zallen, et al., The Generalization of Low Emission Coal Burner Technology, Proceedings of the Third Stationary Source Combustion Symposium, vol. 2, EPA 600-7, 79-050 B (Feb. 1979).

Liang, et al., Potential Applications of Furnace and Limestone Injection for $SO_2$ Abatement, presented to Coal Technology Conference, Houston, Tex., Nov. 13-15, 1984.

Cole, et al., Reactivity of Calcium-Based Sorbents for $SO_2$ Control, (PROCEEDINGS) Proceedings: First Joint Symposium on Dry $SO_2$ and Simultaneous $SO_2$ $ND_x$ Control Technologies, EPA-600/9-85-020a, Paper No. 10 (Jul., 1985).

Martin, et al., EPA Limb R&D Program-Evolution, Status, and Plans, PROCEEDINGS, EPA-600/9-8-5-020a, Paper No. 3 (Jul. 1985).

Rakes, et al., Performance of Sorbents With and Without Additives, Injected Into A Small Innovative Furnace, PROCEEDINGS, EPA-600/9-85-020a, Paper No. 13 (Jul. 1985).

Kelly, et al., Pilot-Scale Characterization of a Dry Calcium-Based Sorbent $SO_2$ Control Technique Combined With a Low $NO_x$ Tangentially Fired System, PROCEEDINGS, EPA-600/900-85-020a, Paper No. 14 (Jul. '85).

Overmoe, et al., Boiler Simulator Studies on Sorbent Utilization for $SO_2$ Control, PROCEEDINGS, EPA-600/9-85-020a, Paper No. 13 (Jul. '85).

Larson, Burner Developments to Meet Potential Acid Rain Reduction Requirements, Presentation to Committee on Power Generation, assoc. of Edison Illumination Company, Phoenix, Ariz. (Apr. 1984).

Giammar, et al., Evaluation of Emissions and Control Technology for Industrial Stoker Boilers, EPA 600-7, 79-050 B (Feb. 1979).

Rising, et al., Advanced Development of a Coal/Limestone Fuel Pellet for Industrial Boilers, 1982 Joint Symposium on Stationary Combustion $NO_x$ Control, vol. II, EPA Contact No. 68-02-3695, pp. 1-5.

Merryman, et al., In-Situ Capture of Sulfur in Combustion, Spring Technical Meeting of the Central States Section of the Combustion Institute, Columbus, Ohio 23 pages (Mar. 22, 1982).

Carr, et al., Low $NO_x$ Combustion Controls and Dry Sorbent Furnace Injection, Acid Rain Conference, pp. 1-28.

Giovanni, et al., Impact of Sorbent Injection on Power Plant Heat Rates, pp. 1-8.

Harman, et al., Prospects and Problems in Coal Use, Ohio Dept. of Energy, Spring Technical Meeting Central State Section, (Mar. 22 and 23, 1982).

*Primary Examiner*—Carl F. Dees

*Attorney, Agent, or Firm*—Sheridan, Ross & McIntosh

[57] ABSTRACT

A method and composition are provided for decreasing emissions of sulfur oxides and nitrogen oxides upon combustion of carbonaceous fuel material. In particular, the composition comprises a refined coal, having low ash-forming material and inorganic sulfur content, a sulfur sorbent, a sulfation promoter, and a catalyst for the reaction of sulfur dioxide to sulfur trioxide. Reduced emissions of sulfur oxides are achieved by combusting the composition in an oxygen restricted burner to lessen the effect of sorbent sintering while obtaining other advantages associated with mixing a sulfur sorbent with the carbonaceous material prior to combustion. Nitrogen oxides emissions are reduced by use of an oxygen restricted burner which lowers the flame temperature. Nitrogen oxides emissions are also reduced by lower flame temperatures resulting from endothermic reactions which are undergone by the sulfur sorbent and promoter.

21 Claims, No Drawings

METHOD AND COMPOSITION FOR DECREASING EMISSIONS OF SULFUR OXIDES AND NITROGEN OXIDES

FIELD OF THE INVENTION

The present invention relates to an improved method and composition for reduction of emission of sulfur and nitrogen oxides from the combustion of carbonaceous material. In particular, the process relates to the reduction of emissions by capturing sulfur oxides with alkaline earth metal sorbents and reducing nitrogen oxide emissions by lowering the flame temperature.

BACKGROUND OF THE INVENTION

The burning of fossil fuels, including coal, is necessary to meet the energy requirements of our society. However, the combustion of coal, and in particular, many lower grades of coal emits sulfur oxides into the atmosphere. Additionally, nitrogen oxides are produced during combustion. Some nitrogen oxides are derived from fuel-bound nitrogen, while some are derived from atmospheric nitrogen. High flame temperatures fix the nitrogen in combustion gases to one or more oxides of nitrogen. Single-stage burners are associated with high flame temperatures. One method of reducing the formation of nitrogen oxides is to employ burners in which combustion is staged to lower flame temperatures.

The release of sulfur and nitrogen compounds produces many detrimental environmental effects. Respiration of these pollutants can cause human health problems ranging from mild respiratory irritation to more serious chronic diseases. Both sulfur oxides and nitrogen oxides can also react with other compositions in the atmosphere to form acid precipitation which has the effect of acidifying bodies of water and destroying the wildlife which live in such habitats. Acid precipitation can also destroy man-made structures such as buildings and statues.

Industry has sought to burn low sulfur coal to avoid problems associated with sulfur oxide emissions. However, such fuel is not always readily available and the costs to recover and transport such high quality coal is in many cases prohibitive. Therefore, to meet the objective of environmentally acceptable coal combustion, methods have been developed to remove sulfur compounds from the coal before combustion and to remove sulfur and nitrogen oxides during the combustion process as the gases are being cooled, but before release to the atmosphere.

Recent revisions in the Federal Clean Air Act applicable to new sources require, for high sulfur coal, a ninety percent reduction in pounds of sulfur per million Btu before release to the atmosphere of combustion by-products. The Clean Air Act, therefore, makes it necessary to achieve higher reductions in sulfur in emissions from the combustion of coal.

Numerous methods for removing sulfur oxides from gaseous waste streams are known, including wet scrubbing processes and sorbent sulfur capture. The primary goal of such methods is to cause a chemical reaction between sulfur oxides and some additive to form a compound which can be recovered prior to releasing the waste combustion gas stream to the atmosphere. In wet-scrubbing processes, waste gas is passed through a slurry containing a calcium or magnesium compound. The sulfur compound in the waste stream reacts with the calcium or magnesium compound to form an insoluble compound which is effectively removed from the waste gas stream. For example, $SO_2$ dissolves in water to form $H_2SO_3$ which reacts with hydrated lime ($Ca(OH)_2$) to form insoluble calcium sulfite. Wet scrubbing techniques, however, are expensive, require retro-fitting, and can be easily fouled by precipitation or insoluble calcium salts inside the scrubber. Additionally, if a wet scrubbing unit is shut down for maintenance, the power plant must frequently be shut down, as well.

Sulfur compounds can also be captured from a waste combustion gas stream by introducing a material containing an alkaline earth metal, commonly calcium, as a sorbent to the combustion system. In such processes, an alkaline earth metal oxide is formed during combustion and reacts with sulfur oxides to form solid sulfur containing compounds which can be removed from the exhaust gas with, for example, electrostatic precipitators. The reactions by which sulfur is captured involve a series of complex physical and chemical processes which are not completely understood. The sulfur-capture reactions involving limestone are believed to involve the following calcination and sulfation reactions:

$$CaCO_3 \rightarrow CaO + CO_2 \quad (1)$$

$$CaO + SO_2 + \tfrac{1}{2}O_2 \rightarrow CaSO_4 \quad (2)$$

Calcium sulfate ($CaSO_4$) is a solid material which can be removed from the exhaust gas before release to the atmosphere.

The use of calcium based sulfur sorbents is well known. For example, in Maloney, *Sulfur Capture in Coal Flames,* AIChE Symposium Series, Vol. 76, (1980) methods of sulfur capture by the use of alkaline earth metals added to the combustion chamber of coal fired boilers are reviewed. Maloney states that sulfur retention levels off at about eighty-five percent at calcium to sulfur (Ca/S) molar ratios of 3.5 to 4.

Giammar, et al., *Evaluation of Emissions and Control Technology for Industrial Stoker Boilers* EPA 600/7-81-090, p. III-86 (May 1981) conducted studies on pellets formed from limestone and coal with Ca/S molar ratios of 3.5, and obtained sulfur retention of up to 67%. With a Ca/S molar ratio of 4, sulfur retention of 64% was attained. As the Ca/S molar ratio was increased to 7, sulfur retention increased to 73%.

Zallen, et al., *The Generalization of Low Emission Coal Burner Technology,* Proceedings of the Third Stationary Source Combustion Symposium, Vol. 2, EPA 600-7, 79-050B, February 1979, disclosed a system where limestone is pulverized with coal and directly fired in a low $NO_x$ burner boiler simulator. For Ca/S molar ratios of 1, 2, and 3, sulfur captures of 50%, 73%, and 88%, respectively, were achieved. In all three tests, the coal used was Utah low sulfur coal.

Liang, et al., *Potential Applications of Furnace Limestone Injection for $SO_2$ Abatement,* presented to Coal Technology Conference, Houston, Tex., Nov. 13–15, 1984, compared the effectiveness of $SO_2$ reduction between injection of limestone at various locations in coal boilers. Liang reported sulfur dioxide capture of about 34% for limestone mixed with coal prior to combustion, about 38% for limestone introduced between burners, and about 51% for limestone introduced into the upper furnace. In these experiments, Ohio #6 coal was combusted and Kemco limestone was the source of calcium. Liang concluded that limestone injection with the coal is the least effective method for sulfur dioxide capture and that injection through the upper furnace ports achieves the highest capture levels for a given set of furnace conditions.

In one study, Cole, et al., *Reactivity of Calcium-Based Sorbents for $SO_2$ Control,* Proceedings: First Joint Symposium on Dry $SO_2$ and Simultaneous $S_2/NO_x$ Control Technologies, EPA-600/9-85-020a, Paper No. 10 (July 1985), sulfur sorbent reactivity was compared. In terms of calcium utilization, dolomites were most reactive, hydroxides were less reactive, and calcites were least reactive, based on the percent calcium from the sorbent as a sulfate.

A well recognized problem associated with introduction of sulfur sorbents into combustion zones is sintering of sorbents due to high temperatures which causes loss of sulfur capture capacity. Martin, et al., *EPA's LIMB R&D Program-Evolution, Status, and Plans,* Proceedings: First Joint Symposium on Dry $SO_2$ and Simultaneous $SO_2/NO_x$ Control Technologies, EPA-600/9-85-020a, Paper No. 3 (July 1985), recognized the sintering problem, also known as "dead burning", as the heating of limestone to a temperature above which fresh calcium oxide recrystallizes, causing the sulfur capture reactivity to decrease dramatically due to a loss of surface area.

Rakes, et al., *Performance of Sorbents With and Without Additives, Injected Into a Small Innovative Furnace,* Proceedings: First Joint Symposium on Dry $SO_2$ and Simultaneous $SO_2/NO_x$ Control Technologies, EPA-600/9-85-020a, Paper No. 13 (July 1985), compare the effectiveness of three sulfur sorbents on calcium utilization (averaged for Ca/S molar ratios of 1 and 2, between injection of the sorbent through the burner and downstream injection of the sorbent at temperatures of about 2200° F. to 2300° F. For downstream injection Rakes, et al. found a slight increase in calcium utilization for limestone, and a marked increase in calcium utilization for calcium hydroxide and calcium dihydrate.

Kelly, et al., *Pilot-Scale Characterization of A Dry Calcium-Based Sorbent $SO_2$ Control Technique Combined With A Low-$NO_x$ Tangentially Fired System,* Proceedings: First Joint Symposium on Dry $SO_2$ and Simultaneous $SO_2/NO_x$ Control Technologies, EPA-600/9-85-020a, Paper No. 14 (July 1985), investigated the effectiveness of sulfur sorbents when injected in the combustion zone and in downstream locations. Kelly, et al. concluded that sulfur sorbents should be injected downstream to avoid sorbent deactivation by high peak temperatures in the combustion zone. Kelly, et al. also suggest that the residence time of calcium-based sulfur sorbents in the temperature zone between about 2250° F. to about 1800° F. should be maximized to maximize sulfur capture.

Overmoe, et al., *Boiler Simulator Studies On Sorbent Utilization for $SO_2$ Control,* Proceedings: First Joint Symposium on Dry $SO_2$ and Simultaneous $SO_2/NO_x$ Control Technologies, EPA-600/9-85-020a, Paper No. 15 (July 1985), compared the sulfur capture between downstream injection and fuel injection for limestone and dolomite sorbents. The results of both sets of tests suggest that downstream injection of sorbents increases the sulfur capture capacity of the oorbents. The sorbents were injected downstream at temperatures of about 2250° F.

The United States Environmental Protection Agency has been conducting a Limestone Injection Multi-Stage Burner (LIMB) Program for research on methods for reducing sulfur oxides emissions from the combustion of coal with limestone sulfur sorbents. The primary emphasis of this multi-million dollar LIMB Program has been toward injection of limestone sulfur sorbents downstream from the combustion zone where temperatures have cooled to about 2250° F. In such systems, the limestone sorbent must be rapidly and completely dispersed throughout the cross-section of a boiler where the combustion gases are rapidly flowing and the area of the cross-section is typically about 2500 square feet.

Magnesium compounds do not capture sulfur compounds to any appreciable extent at the high temperatures found in a boiler environment. Above 1500° F. and for gas concentrations typically found in the boiler, magnesium sulfate is unstable. Magnesium oxide, however, is produced in the high temperature oxidizing environment of the boiler. Below 1500° the reaction of sulfur dioxide with magnesium oxide is exceedingly slow, while sulfur trioxide readily reacts with magnesium oxide below 1500° F. The concentration of sulfur trioxide in the boiler gases is quite low, however, and its formation from the reaction of sulfur dioxide with oxygen is very slow unless catalyzed.

While various methods for reduction of sulfur oxides and nitrogen oxides emissions are known, such methods are expensive and/or not effective. Wet-scrubbing is the principal commercial method for sulfur oxides reduction. While this technology effectively removes sulfur oxides, it is expensive and can add from thirty-three to sixty-five dollars per ton to the cost of coal to achieve a ninety percent reduction in sulfur emissions. The cost to retrofit an existing facility with a wet scrubber can, in some cases, equal the cost of the facility. The cost of such retrofits requires recapitalization. For older facilities, amortizing such costs over a short remaining lifespan is impractical.

Although the current Federal Clean Air Act New Source Performance Standards requiring a ninety percent reduction in pounds of sulfur per million Btu only apply to facilities built after 1977, environmental concerns about acid rain could initiate new legislation applying to older facilities, as well. Additionally, some states have stricter laws than current federal legislation. Presently, most coal fired utility boilers are more than twenty-five years old and have no desulfurization equipment. As discussed above, major disadvantages are associated with retrofitting such facilities with wet scrubbing equipment.

Accordingly, there is a need for a method for economically reducing emissions of sulfur oxides in existing coal-burning facilities. The present invention involves a customized fuel composition for reduction of sulfur oxides. Eighty percent reduction of sulfur oxides can be achieved with the present composition and still be more economical than wet scrubbing processes. Additionally, while the composition is more expensive than untreated coal, any cost increases to electric utilities can be incorporated into existing rate bases without the need for recapitalization. The present fuel composition is also advantageous because a utility can switch to use of the composition witout a need to change existing storage facilities.

The use of various sulfur sorbents and sulfation promoters is known, as is the use of coal which has been cleaned to reduce inorganic sulfur. It has not, however, been previously recognized that the combination of a refined coal having substantial reductions in pyrite and other ash-forming minerals, a sulfur sorbent including a calcium and a magnesium component, a sulfation promoter, and a catalyst for the conversion of sulfur dioxide to sulfur trioxide, when combusted in an oxygen restricted combustion zone, can achieve highly effective sulfur oxides and nitrogen oxides reduction.

Formation of sulfur oxides is reduced by the present invention because of the low pyrite content in the refined coal. Additionally, the refined coal is low in silicates and aluminosilicates, which otherwise effectively compete with sulfur oxides for reaction with sorbents at higher temperatures. Sulfur oxides which are formed from sulfur in the coal react with calcium and magnesium components of the sorbent. When magnesium is present in the sorbent in dolomitic form, the rate of calcium sulfation at higher temperatures is increased although the magnesium portion of dolomite is not sulfated. The use of a catalyst for production of sulfur trioxides enhances sulfation by the dolomitic magnesium which remains unsulfated by assuring that sufficient quantities of sulfur trioxides are present. Sorbent sintering and formation of nitrogen oxides are reduced by lower flame temperatures which are achieved by use of a low $NO_x$ burner and the endothermic conversion of sorbents to the oxide form.

In addition to reducing sulfur and nitrogen oxides, the fuel composition of the present invention has a number of favorable operational impacts on a boiler. The cost of pulverizing coal is reduced because less power is required to break up an agglomerated material than coal. Slagging is reduced because the refined coal has low amounts of ferrous iron and silicates. Fouling is reduced because of the low sulfur content of the fuel and the addition of calcium. Ash burden is decreased because, although the addition of sorbents increases the ash, a low ash coal is the starting material for the fuel composition.

SUMMARY OF THE INVENTION

In one embodiment the present invention involves a carbonaceous fuel composition for combustion in an oxygen restricted combustion zone. Upon combustion of the composition, formation of nitrogen oxides is reduced and sulfur oxides formed during combustion are captured to reduce emissions of these compounds to the atmosphere. The composition includes a refined particulate coal having a pyritic sulfur content which is less than that of unrefined coal and having reduced levels of other ash-forming minerals. The composition also includes a sulfur sorbent which includes a calcium and a magnesium component. After combustion, the sulfur sorbent reacts with sulfur oxides formed by the combustion of the composition to form particulate matter which can be removed from the exhaust stream. The composition includes a sulfation promoter which increases the capture of sulfur oxides by the sulfur sorbent. The composition also includes a catalyst for converting sulfur dioxide to sulfur trioxide in amounts effective to produce a sulfur species which will readily react with magnesium oxide formed from the magnesium component of the sorbent to form magnesium sulfate.

In another embodiment of the invention, the ash content of the refined coal is less than about five percent by weight and the pyritic sulfur content is less than about five-tenths of one percent by weight. The fuel composition can include at least about sixty percent by weight refined coal. The sulfur sorbent is present in the composition in an amount sufficient to provide a calcium to total sulfur content ratio of at least about 1, and the promoter is present in amounts equal to at least about one percent by weight of the sulfur sorbent.

Another embodiment of the invention involves a process for reducing emissions of sulfur oxides and nitrogen oxides from the combustion of coal. This process includes forming a fuel material including refined particulate coal, a sulfur sorbent comprising calcium and magnesium, a sulfation promoter, and a catalyst. An oxygen restricted combustion zone is provided for combustion of the composition. The composition is introduced into the combustion zone and combusted. The combustion temperature of the process can be between about 2300° F. and about 2700° F. A still further embodiment of the invention includes confining the combustion products in the exhaust system of a furnace to allow for reaction of sulfur oxides and the sulfur sorbent until the combustion product cools to a temperature below about 700° F.

DETAILED DESCRIPTION OF THE INVENTION

A carbonaceous fuel composition low in sulfur and ash-forming minerals containing a sulfur sorbent and other additives and methods for producing and combusting the composition are provided which allow for the addition of the sorbent with the fuel material into the combustion zone to effectively remove sulfur oxides by reactions with sorbents to form solid products, and to inhibit the formation of nitrogen oxides by the method of combustion and effect of the sorbents on flame temperature. As used herein, the term "combustion zone" refers to the area in a furnace in the immediate vicinity of the burners which is characterized by temperatures at or near to the flame temperature of the combustion process. Although the sorbents are introduced in the combustion zone of the boiler, the disadvantages of sorbent sintering are avoided by controlling the combustion temperatures and using sulfation promoters.

Numerous advantages are achieved by adding the sorbent and other additives with the fuel into the combustion zone of the boiler. An important advantage of introducing the alkaline earth metal sorbents and additives into the combustion zone of, for example, a coal boiler, is complete mixing of the sorbent with the coal combustion products. Since the sorbent is intimately mixed with the fuel material prior to combustion, upon combustion, complete mixing is automatccally achieved thereby providing maximum contact between the sorbent and sulfur oxides compositions. In this manner, more complete reaction between the sorbent and sulfur compositions is achieved.

A second advantage of introducing the sorbent directly into the combustion zone is that the sorbent is present with the sulfur oxides during the entire time that temperatures are favorable for sulfation. For calcium-based sorbents to capture sulfur oxides, the temperature must be below the decomposition temperature of calcium sulfate under the gas concentration conditions in the boiler. Under typical boiler conditions, the decomposition temperature is about 2250° F. Below a temperature of about 1600° F., however, the reaction of calcium-based sorbents with sulfur dioxide is too slow to be significant. These temperatures define a capture temperature window within which calcium-based sorbents can react with sulfur dioxide. It is known that the extent of sulfur oxides capture is strongly related to the amount of time the sorbent and sulfur oxides are together within the capture temperature window. In a boiler, the location where the capture temperature window occurs depends upon whether the boiler is fired at full load or at a reduced load. By introducing the sorbent with the fuel, the sorbent will be completely mixed with the combustion gas stream during the entire capture temperature window. By comparison, in a downstream injection system, injection of the sorbent across the entire cross-section of the boiler is attempted at the location in the boiler where the gases have cooled to between about 2100° F. and about 2400° F. and, more particularly to about 2250° F. If, however, the boiler load is increased or decreased, the previously perfect injection location is either too hot, which causes sintering of the sorbent, or too low, which shortens the time available for reactions to occur thereby reducing capture. Additionally, if the sorbent is only introduced immediately at the point in the combustion gas stream where sulfur capture reactions are favored by temperature, some amount of time is lost for sulfur capture while the sorbent undergoes calcination reaction to form an oxide for reaction with a sulfur species.

A third advantage of introducing the sorbent in the combustion zone is that simpler and less expensive apparatus is required. For example, if the sorbent is formed into pellets with coal or simply mixed in powdered form with the coal, no additional ducts, ports, metering devices or controls for injection of the sorbent are required. Additionally, the material can be handled and transported without the need for separate facilities for sorbent material. Thus, the process can be practiced substantially without retrofitting.

The primary component of the present fuel composition is refined coal. As used herein, the term "refined coal" refers to a coal material having less than about ten percent by weight ash forming material and more preferably less than about five percent by weight ash forming material. "Refined coal" also can refer to coal having less than about one percent by weight pyrite and more preferably less than about five-tenths of one percent by weight pyrite. Methods for reducing the pyritic sulfur content and ash forming material content of coal are known. For example, a preferred method for cleaning coal is disclosed in the commonly owned, co-pending patent application filed on even date herewith, "Process for Beneficiating Particulate Solids". Some sources of coal are naturall low in ash forming material and pyrite and may meet or exceed the above limits for refined coal.

By starting with a refined coal, the of sulfur present in the composition which forms emissions of sulfur oxide is reduced. Inorganic sulfur is present in coal principally in the form of pyrite and can be liberated from coal by grinding coal to a small particle size to release discrete pyrite particles and separating refined particulate coal from refuse material.

Refined coal is also characterized by having low amounts of ash forming components. This aspect of refined coal is beneficial for several reasons. The economics of the overall combustion process are improved because less ash is formed, resulting in decreased ash removal costs. Additional ash produced by the combustion of coal can cause slagging and fouling within the boiler. However, the use of refined coal reduces slagging because refined coal is low in ferrous iron, silicates and total ash, all of which increase formation of slag in the boiler. Further, the use of refined coal reduces fouling because refined coal is low in sulfur and total ash, both of which tend to increase fouling. As a of result decreased ash formation from naturally occuring ash forming substances, beneficial additives can be mixed with the refined coal to form a fuel composition without increasing the total ash formation acceptable levels.

Refined coal is the primary component by weight of the present fuel composition. The other of elements the composition are included in the on the basis of need for increased sulfur oxides capture and nitrogen oxides reduction. For example, if the source of refined coal has a given amount of sulfur, sufficient sorbent can be added to achieve a desired Ca/S molar ratio. Typically, the fuel compositio includes at least about sixty percent by weight refined coal, more preferably at least about eighty percent by weight refined coal, and most preferably at least about ninety-five percent by weight refined coal.

For example, in the three cases described above, if the refined coal has a one percent by weight pyritic sulfur content, the total composition has a pyritic sulfur content by weight of, respectively, 0.6%, 0.8%, and 0.95%. Similarly, for refined coal having a ten percent by weight ash forming material content, the total composition has a contribution of ash from coal of, respectively, 6%, 8%, and 9.5%.

It should be recognized that, in addition to refined coal, other types of carbonaceous materials can be included in the fuel composition. Such materials can include residual petroleum bottoms, oil, bitumen, kerogen, and mixtures thereof. Addition of such materials typically increases the overall sulfur content of the composition. For effective reduction of sulfiur emissions, such increases should be offset by use of a refined coal having a low pyrite content or by adjustments in other aspects of the present invention.

Numerous compositions are known to react as sorbents with sulfur oxides in combustion gases from the burning of fuel material to form particulate matter which can be removed from the combustion gas stream. As used herein, the term "sulfur sorbent" refers to a sulfur capturing composition in the fuel material prior to combustion, as well as the composition which eventually reacts with a sulfur oxide. For example, limestone ($CaCO_3$) is a sulfur sorbent which forms calcium Oxide (CaO) during combustion and calcium oxide is the species which eventually reacts with sulfur dioxide to form a solid material. Both limestone and calcium oxide are referred to as a sulfur sorbent. Sulfur sorbents are introduced in the higher temperature regions of the boiler, that is, at temperatures generally a 1600° F. and more particularly at or above 2250° F. Sulphur sorbents usually contain calcium compounds which react with sulfur oxides to form calcium sulfate. The sulfate, which is solid, can be removed from the combustion gases by, for example, electrostatic precipitators. Such sulfur sorbents include but are not limited to, lime, limestone, hydrated lime, calcium oxide, dolomite, burnt dolomite, and atmospheric or pressure hydrated (burnt) dolomite. Generally, as disclosed by Cole, et al., supra, dolomitic sulfur sorbents have been found to capture more sulfur oxides compared on an equal molar basis of calcium than calcium containing compounds which do not contain significant quantities of magnesium, such as limestone, lime and hydrated lime. This effect is apparently due to the physical effect magnesium has in keeping the crystal structure open so that sulfur dioxide and get to the calcium oxide where they react to form calcium sulfate.

Other sorbents for sulfur oxides include materials usually containing alkali metals such as sodium carbonate, sodium bicarbonate and trona. When added in large quantities as the principal sulfur sorbent, these sorbents are added in the lower temperature regions of the boiler because these materials are known to cause and severely aggravate the slagging and fouling properties of the ash. Typically, these alkali metal containing compounds are added as a solution which is sprayed into the combustion gases after most of the sensible heat has been recovered. The sulfur oxides in the combustion gas react with the alkali metal and also evaporate the liquid to form dry solid sulfur-containing alkali metal compounds. Alternately, these alkali metal compounds are added dry into the low temperature region of the boiler.

When calcium-based sorbent materials are introduced into a combustion system, they initially undergo a calcination reaction to form an oxide. For example, calcium carbonate reacts to form calcium oxide and carbon dioxide. The calcination reactions endothermic, and therefore, reduce the heat available for recovery. However, this reduction in temperature causes the very important benefit of reducing the formation of nitrogen oxides, the formation of which is temperature dependent.

The amount of sorbent introduced in a boiler is commonly measured by a calcium to total sulfur content molar ratio (Ca/S) for calcium containing sulfur sorbents. As used herein, "total sulfur content" refers to the sum of organic, pyritic, sulfate, and elemental sulfur in a fuel composition. It is generally recognized that increased sulfur capture can be achieved with increased Ca/S ratios. However, a number disadvantages are associated with increased calcium including higher operating cost as well as higher formation. The present fuel composition typically includes a calcium based sulfur sorbent in amounts with a Ca/S molar ratio of between about 1 and about 4, more preferably between about 1.5 and about 3.5, and most preferably between about 2 and about 3. It is expressly recognized, however, that these values are not strictly limiting to the present invention and that other values may be used when the other sulfur oxides emissions reduction factors identified by this so require. Total sulfur content is determined by a standard ASTM total sulfur content determination procedure.

As discussed above, sintering of sulfur sorbents has led those in the art to propose of introduction of sulfur sorbents downstream in a combustion system to avoid high temperatures only associated with the combustion zone. Sintering of sulfur sorbents is time and temperature dependent and generally occurs during and/or immediately subsequent to the calcination reaction. Calcination occurs to form, for example, calcium oxide, a porous material comprised of many small, high surface area crystals. Such crystals then react with sulfur containing compounds to form sulfates which are removed from the combustion gas stream. However, if such calcination reactions proceed at too high a temperature for a relatively long time or at even higher temperatures for a shorter time, the formation of larger cacium oxide crystals is increased. The occurrence of such large crystals decreases the total surface area of the calcined compound, and therefore, the overall sulfur capture capacity of the system.

As discussed above, the problem of sorbent sintering has been addressed by others by introducihg the sorbent to the combustion process sufficiently long after combustion for the combustion gases containing sulfur oxides to cool below the point where rapid sintering occurs. There are two major disadvantages to this approach. The first is that sufficient miling of the sorbent with the combustion gas for complete sorbent utilization is difficult to obtain when injecting sorbent into the furnace after combustion. Incomplete mixing decreases the efficiency of sulfur capture by the sorbent. The second problem is that the sorbent may be introduced after the beginning of the sulfur capture temperature window. The temperature range in which calcium sulfation proceeds occurs in a relatively short time period, lasting usually only about 1.5 to about 2 seconds. Therefore, if sorbent is not introduced and mixed prior to this temperature range, significant decreases in sorbent efficiency can result. Therefore, it is highly desirable to have the sulfur sorbent present and completely mixed at the beginning of the calcium sulfation temperature window with calcination of the sorbent substantially completed. A slight delay can result in decreased total sulfur capture. However, if the sorbent is introduced at temperatures above the sintering temperature, sintering occurs and the sulfur capture capacity is reduced The present invention addresses the problem of sorbent sintering in two ways. First, combustion temperatures are reduced to minimize the unacceptable sintering which occurs at high temperatures. Temperature reduction is achieved primarily by the use of low-$NO_x$ burners. Additionally, the endothermic calcination reactions also reduce flame temperature as discussed below. Second, sulfation promoters are employed to increase sulfation. While sulfation promoters appear to increase sintering, the promoters also cause in even greater increase in the extent of the sulfation reaction. The net effect is greater sulfation which than without the promoter. For these reasons, in the presence of a sulfation promoter, the sulfur sorbent can be mixed with the refined coal prior to combustion to achieve the advantages associated therewith.

Combustion zone temperatures can be controlled by adjusting the amount of oxygen which is fed to the boiler between the combustion zone with the fuel (primary air) and air admitted at secondary or tertiary locations. Typically, burners for controlling emission of nitrogen oxides conduct combustion in oxygen restricted environments to limit combustion temperatures. A primary factor in the formation of nitrogen oxides is combustion temperature. Such low $NO_x$ burners control the combustion reaction in a boiler by limiting the amount of oxygen in the combustion zone to substoichiometric amounts. Boilers operated to control $NO_x$ formation are also useful for the reduction of sintering of alkaline earth sorbents, because high tmperatures which cause sintering can be avoided, thereby making sulfur sorbents more effective. Low $NO_x$ burners typically control combustion temperatures between about 2400° F. and about 2700° F., and more particularly between about 2500° F. and about 2600° F. Conventional burners typically operate at temperatures greater than about 2900° F. One low $NO_x$ burner which when combusting a Wyodak Subbituminous coal maintained the combustion temperature below about 2250° F. is a staged controlled Combustion Venturi burner with tertiary air ports reported by the Riley Stoker Corp. of Worchester, Mass. Larson *Burner Developments to Meet Potential*

*Acid Rain Reduction Requirements,* presentation to Committee on Power Generation, Association of Edison Illumination Company, Phoenix, Ariz., (April 1984).

The flame temperature in combustion of fuel material of the present invention is lowered by the endothermic calcination reactions of the sulfur sorbents and sulfation promoters, as well as by the use of low-$NO_x$ burners.

The problem of sorbent sintering is also adoressed by the present invention by including sulfation promoters in the fuel composition to increase sulfation by sulfur sorbents. A number of compounds have been recognized as sulfation promoters, including, $Na_2CO_3$, $Cr_2O_3$, $NaHCO_3$, $K_2CO_3$, $KHCO_3$, $Li_2CO_3$, $Na_2SO_4$, $K_2SO_4$, $MoO_3$, $V_2O_5$, $TiO_2$, Pt, $P_2O_5$:, and NaCl. These promoters have been found to increase the calcium utilization in sulfation reactions. Without wishing to be bound by theory, it is thought that some sulfation promotors may increase sintering of sulfur sorbents which tends to decrease sulfur capture, but the disadvantage caused by this decrease in surface area is offset, at least in part, by the advantages derived from sulfation promotion activity of the promoter.

The amount of sulfation promoter added to the fuel composition in the present invention depends upon several factors, including the reactivity of the promoter, the amount of sulfur oxides reduction needed, and the effectiveness of the sulfur sorbent. The amount of promoter added to the fuel composition to enhance the capture of sulfur oxides by the sulfur sorbent is generally equal to at least about 1% by weight of the sulfur sorbent, more preferably at least about 3% by weight of the sulfur sorbent, and most preferably at least about 5% by weight of the sulfur sorbent. However, to minimize the overall cost of removing sulfur and nitrogen oxides as well as minimizing an detrimental effect the promoter may have in the boiler, the minimum amount of promoter required to achieve the desired capture is generally employed.

The amount of promoter can also be affected by the cleanliness of the coal. It is known that sulfation promoters which contain alkali metals are partially inactivated by ash-forming materials. Accordingly, the use of sulfation promoters is particularly beneficial in the present invention for use with refinec coal having a low content of ash-forming minerals because the amount of promoter can be minimized. As the amount of ash forming material in coal increases, the amount of alkali metal promoter must be increased to achieve an equal sulfation promotion effect.

It should be recognized that when sodium containing compounds are included in a fuel composition as a promoter, the amount of the compound is small relative to the amount of primary sulfur sorbent. This use of sodium compounds should be distinguished from the use of such compounds as primary sulfur sorbents is discussed above which requires addition of the compounds in lower temperature regions of the boiler due to adverse effects of aggravating slagging and fouling of ash. The use of sodium sulfation promoters increases sulfation by calcium based sorbents far in excess of any sorbent activity the sodium compound exhibits alone. While slagging and fouling can be slightly increased by the small amounts of sodium compounds used as promoters, this negative effect is greatly out-weighed by the increase in sulfur capture by calcium based sorbents. Moreover, calcium and magnesium in the sorbent act as antagonists to slagging of sodium and thus, further reduce any negative effects of sodium promoters.

It has been determined that, in addition to sorbent sintering, effective sulfur capture by sorbents introduced in the combustion zone in conventional burner systems can be impaired by the presence of high amount of ash forming material which can compere with sulfur oxides for reaction with sorbents. When a calcium-based sulfur sorbent is introduced with a fuel material, ash forming components of the fuel material can react with the sorbent after combustion. The composition of ash forming materials in coal varies widely and is complicated. The chemistry of reactions of such ash forming materials during the combustion of coal is extremely complex with many materials forming compounds, such as glasses and slags. Two reactions which commonly occur during the combustion of coil are provided below for purposes of illustration and are not intended in any way to completely define the chemical reactions during the combustion of coal.

$$CaO + SiO_2 \rightarrow CaSiO_3 \quad (3)$$

$$CaO + Al_2O_3 \rightarrow CaAl_2O_4 \quad (4)$$

These and similar reactions between sulfur sorbents and ash forming materials occur at high temperatures at which $CaSO_4$ is unstable (above about 2250° F.). Such reactions, therefore can deplete available calcium oxide before the combustion gases cool to a temperature at which sulfation can occur. Accordingly, during and immediately after combustion, when temperatures are at a maximum, sulfur sorbents are more likely to react with ash forming materials which are present than with sulfur oxides. As temperatures cool downstream in the boiler, sulfation reactions eventually become favored. If a sulfur sorbent is preeent only in a limited quantity, the sorbent can be depleted by reactions with ash forming materials before reacting with sulfur oxides.

The present invention addresses the problem of competition for sulfur sorbents between ash torming and sulfur oxides in two ways. The combustion temperature of the fuel material is lowered by use of a low-$NO_x$ burner and endothermic calcination reactions of sulfur sorbents and promoters. These temperature reductions are also benefical for improving the thermal conditions for competition for sulfur sorbents by sulfur oxides. The present invention also addresses the problem of competition for sulfur sorbents by ash forming materials by providing a substantially refined coal. Such refined coal initially has a low ash content. Accordingly, there is a smaller amount of material competing with sulfur oxides for reaction with sulfur sorbents.

The present invention is also directed toward using a magnesium sulfur sorbent, and in particular, to utilizing the magnesium content of dolomitic materials. By way of example, the following sequence of reactions can occur upon injection of dolomite with the fuel into a boiler.

$$CaCO_3.MgCO_3 \rightarrow CaO.MgO + 2\ CO_2 \quad (5)$$

$$CaO.MgO + SO_2 \tfrac{1}{2} O_2 \rightarrow CaSO_4.MgO \quad (6)$$

$$CaSO_4.MgO + SO_3 \rightarrow CaSO_4.MgSO_4 \quad (7)$$

Reaction (5) occurs in the highest temperature ranges of the boiler producing the oxide for sulfation. Below approximately 2250° F., the calcium sites in the mixed oxide begin to sulfate. The magnesium oxide, however, cannot be sulfated until the temperatures drop below about 1500° F. where magnesium sulfate is stable under the gaseous conditions in the boiler. Below the temperature where magnesium sulfate is stable, the reaction of magnesium-based sorbents with $SO_2$ is too slow to be significant.

At temperatures below about 1500° F., however, magnesium-based sorbents readily react with sulfur trioxide. Formation of sulfur trioxide for magnesium sulfation is a limiting factor. While formation of sulfur trioxide according to the following reaction is favored at temperatures below 1500° F., the reaction is slow.

$$SO_2+\tfrac{1}{2}O_2 \rightarrow SO_3 \quad (8)$$

To increase the formation of sulfur trioxide at temperatures below about 1500° F., a catalyst for the reaction of sulfur dioxide to sulfur trioxide is added to the fuel composition. In this manner, increased levels of sulfur trioxide are present in the combustion gas stream and are present for reaction with magnesium oxide to form magnesium sulfate.

Any catalyst suitable for this reaction and stable under combustion conditions can be used. $Fe_2O_3$ is a suitable catalyst for this reaction. Other possible catalysts include but are not limited to platinum (Pt), nickel sulfate ($NiSO_4$), cobalt sulfate ($CoSO_4$), vanadium oxides (e.g. $V_2O_5$), tungsten oxides (e.g. $WO_3$), chromium oxides (e.g. $Cr_2O_3$), molybdenum oxides (e.g. $Mo_2O_3$, $MoO_3$), iron oxides (e.g. $Fe_3O_4$), and mixtures thereof. The amount of catalyst to be added in the present invention depends, in part, on the kinetics of the sulfur dioxide conversion reaction and the sulfur capture reaction. The sulfur capture reaction must occur prior to the particulate collection system of the boiler, such as an electrostatic precipitator or baghouse, so that the sulfur taken from the gas stream and entrapped as a solid is precluded from entering the atmosphere. Therefore, the catalyst, to be completely effective, should convert sulfur dioxide to sulfur trioxide quickly enough for effective sulfur capture to occur in the magnesium sulfation zone. Catalyst concentrations can be determined by experimentation.

While dolomitic compounds are not required as magnesium sulfur sorbents, they are preferred because sulfation of calcium sites in the dolomitic compound is known to be increased by the presence of the magnesium in dolomite. While this effect is observed at a mixture of more than about 5% by weight dolomite ($CaCO_3.MgCO_3$) with limestone, the concentration of dolomite in the sorbent is more preferably greater than about 15% by weight.

While reactions (5), (6), and (7) illustrate the use of a dolomitic magnesium sulfur sorbent, it should be recognized that other magnesium compounds can be used as sulfur sorbents. Such compounds include, but are not limited to $MgCO_3$, $Mg(OH)_2$, MgO, $MgO_2$, and mixtures thereof.

Anti-slagging additives can also be mixed with the coal and other additives to form fuel material. Such additives are disclosed in U.S. Pat. Nos. 4,498,402 to Kober, et al. and 4,372,227 to Mahoney, et al. The additives disclosed in these patents include alumina, silicon carbide, aluminum nitride, strontium carbonate, a mixture of zircon with copper oxychloride, a mixture of alumina with aluminum fluoride, zircon, or zircon chloride, and a mixture of hydrated alumina silicate, unexpanded perlite ore, unexpanded vermiculite ore or strontium carbonate with copper oxychloride, zircon, or zirconyl chloride. Other anti-slagging agents include magnesium, magnesium containing compounds and more particularly include dolomite, burnt dolomite, magnesium carbonate, magnesium oxide, magnesium peroxide, and magnesium hydroxide.

The fuel composition of the present invention can be prepared and used in a furnace in a powdered or bulk form. It is preferable, however, to form agglomerations or pellets from the bulk fuel composition. As used herein, "agglomeration" refers to methods for forming fine particles of coal into larger size units, such as pelletizing, compaction, or agitation, and can include mixing a binder with the coal prior to agglomeration. Materials known to those in the art can be used as binders and include, but are not limited to, coal tars, starches, and asphaltenes. Advantages of agglomeration include improved handling of coal material. Agglomerations are particularly advantageous for coal-fired utilities which use pulverized coal (PC) boilers in which coal material is pulverized before combustion to a particle size less than about 0.075 mm. Energy savings in this pulverizing process are made by using agglomerations of refined coal because agglomerated coal is more easily pulverized than solid coal pieces and a large percentage of the coal particles in the pellets already meet the size requirements for the crushing process.

Some of the binders discussed above, coal tars and asphaltenes, are also useful as weatherproofing agents in agglomerations. Generally, any water insoluble organic material can be used as weatherproofing material to prevent agglomerated fuel material from dissolving upon contact with water.

It will be recognized by those skilled in the art that for sulfur capture by sulfur sorbents to be effective, the combustion products must be confined to allow for sulfur oxides to react with the sulfur sorbent prior to the particulate collector system of a boiler. As used herein, the term "combustion products" refers, collectively, to any compounds or compositions, whether solid, liquid, or gaseous, present in a furnace after combustion, regardless of whether such compounds or compositions were formed during the combustion. Typically, the combustion products are confined within the exhaust system of a furnace until the combustion products cool to a temperature at which sulfation by the magnesium component of the sorbent is not significant. This temperature is generally below about 700° F., and more particularly below about 500° F. A particulate collector system is most beneficially located at a position in the combustion-gas train at which combustion products have cooled to this point.

The composition of coal is highly variable in its original state and after it has been cleaned. Furthermore, sulfur reduction requirements can vary between burner facilities and between states. In view of these factors, the sulfur oxides reduction targets for different facilities are highly variable and accordingly, the type of coal and the amounts and types of sulfur reduction additives are highly variable. Therefore, it is valuable to provide a general method for determining the required cleanliness of coal and effective amounts of additives for sulfur reduction. The present invention includes a method for producing a customized fuel material having low sulfur oxides emissions upon combustion by mixing sulfur reduction additives with refined coal.

As discussed above, there are two components to sulfur reduction: removing sulfur containing material prior to combustion of coal and removing sulfur oxides from combustion gases with sorbents. A particular sulfur reduction target can be met by varying the relative amounts of sulfur reduction between these two components.

The amount of sulfur reduction by post combustion capture depends largely on the amount of sorbent in the fuel composition. Specific amounts of sulfur reduction for relative amounts of additives can be determined by conducting tests in a small test boiler which simulates the time-temperature profile of the targeted boiler. From this information, various compositions having different relative amounts of sorbents, promoters, and catalysts and coal of varying degrees of cleanliness which meet the sulfur oxides reduction target can be determined. Of these various compositions, one can be selected based on economic factors.

The economic decision for selecting a particular composition involves a wide range of variables. Some of the major factors include cost of different sorbents, cost of cleaning coal to a particular cleanliness, and operational costs, such as cleaning slagging and fouling deposits from furnaces and ash removal.

The following example is provided for purposes of illustration only and is not intended to limit the present invention.

EXPERIMENTAL

Pittsburgh #8 coal from the Ireland Mine is provided having an ash content of 30.0% by weight, a pyritic sulfur content of 2.5% by weight, and a total sulfur content of 4.2% by weight. Upon combustion, 8.26 pounds of sulfur dioxide per million Btu is generated. This coal is cleaned to produce a refined coal having an ash content of 3.9% by weight, a pyritic sulfur content of 0.2% by weight, and a total sulfur content of 2.6% by weight. This coal is formed into pellets having the composition shown in Table I.

TABLE I

| Component | Amount (%) |
|---|---|
| Refined Coal | 80.9 |
| Limestone | 6.4 |
| Dolomite | 11.7 |
| Promoter ($Na_2CO_3$) | 0.5 |
| Catalyst ($Fe_3O_4$) | 0.5 |

Upon combustion of these pellets and after an assumed 70% sulfur capture, 1.08 pounds of sulfur dioxide per million Btu remain. This represents a total sulfur reduction from the starting coal material of about 87%. 56% of the sulfur is removed during the refining step and 31% is removed during combustion by capture from a sulfur sorbent.

While various embodiments of the present invention have been described in detail, it is apparent that modifications and adaptations of those embodiments will occur to those skilled in the art. However, it is expressly understood that such modifications and adaptations are within the scope of the present invention, as set forth in the following claims.

What is claimed is:

1. A carbonaceous fuel composition, said composition capable of providing reduced emissions of sulfur oxides and nitrogen oxides upon combustion, said composition comprising:

(a) at least about sixty percent by weight refined particulate coal;

(b) a sulfur sorbent which comprises a calcium and a magnesium component, said sulfur sorbent being present in an amount effective to reduce sulfur oxides emissions upon combustion of said fuel composition;

(c) a sulfation promoter in an amount effective to increase reduction of sulfur oxides emissions by said sulfur sorbent; and (d) a catalyst for converting sulfur dioxide to sulfur trioxide, said catalyst being present in an amount effective to increase sulfur oxides reduction by said magnesium component of said sorbent.

2. A fuel composition as claimed in claim 1, wherein said pyritic sulfur content of said refined coal is less than about one percent by weight of said refined coal.

3. A fuel composition as claimed in claim 1, wherein an ash content of said refined coal is less than about five percent by weight of said refined coal.

4. A fuel composition as claimed in claim 1, wherein said sorbent is present in an amount sufficient to provide a calcium to total sulfur content molar ratio of at least about 1.

5. A fuel composition, as claimed in claim 1, wherein said sulfur sorbent comprises material selected from the group consisting of lime, limestone, hydrated lime, dolomite, burnt dolomite, pressure hydrated burnt dolomite, and mixtures thereof.

6. A fuel composition, as claimed in claim 1, wherein said sulfur sorbent comprises material selected from the group consisting of dolomite, burnt dolomite, pressure hydrated burnt dolomite, and mixtures thereof.

7. A fuel composition, as claimed in claim 1, wherein said sulfation promoter comprises material selected from the group consisting of $Cr_2O_3$, $Na_2CO_3$, $NaHCO_3$, $K_2CO_3$, $KHCO_3$, $Li_2CO_3$, $Na_2SO_4$, $MoO_3$, $V_2O_5$, $TiO_2$, Pt, $P_2O_5$, NaCl and mixtures thereof.

8. A fuel composition, as claimed in claim 1, wherein said catalyst comprises material selected from the group consisting of platinum, nickel sulfate, cobalt sulfate, vanadium oxides, tungsten oxides, chromium oxides, molybdenum oxides, iron oxides, and mixtures thereof.

9. A fuel composition, as claimed in claim 1, wherein said promoter is present in amounts equal to at least about 1 percent by weight of said sulfur sorbent.

10. A fuel composition, as claimed in claim 1, said composition further comprising a binder and wherein said composition is agglomerated.

11. A fuel composition, as claimed in claim 10, in the form of a pellet.

12. A fuel composition, as claimed in claim 1, further comprising carbonaceous material selected from the group consisting of residual petroleum bottoms, oil, bitumen, kerogen, and mixtures thereof.

13. A fuel composition as claimed in claim 1, further comprising weatherproofing material.

14. A process for reducing emissions of sulfur oxides and nitrogen oxides from the combustion of coal, comprising:

(a) forming a fuel material comprising refined particulate coal; a sulfur sorbent comprising calcium and magnesium, said sulfur sorbent present in an amount effective to reduce sulfur oxides emissions upon combustion of said fuel material; a sulfation promoter being present in an amount effective to increase reductions of sulfur oxides emissions by said sulfur sorbent; and a catalyst for converting sulfur dioxide to sulfur trioxide, said catalyst being present in an amount effective to increase sulfur oxides reduction by said magnesium component of said sorbent;

(b) providing an oxygen restricted combustion zone;

(c) introducing said fuel material into said combustion zone; and (d) combusting said fuel material at a combustion temperature to produce combustion products.

15. A process, as claimed in claim 14, wherein said combustion temperature is less than about 2700° F.

16. A process, as claimed in claim 14, further comprising confining said combustion products in an exhaust zone to allow for reaction of sulfur oxides with said sulfur sorbent until said combustion products cool to a temperature below about 700° F.

17. A process, as claimed in claim 14, wherein said fuel material is agglomerated prior to introduction into said combustion zone.

18. A self-scrubbing carbonaceous fuel composition, said composition producing reduced emissions of sulfur oxides and nitrogen oxides on combustion, said composition comprising:

(a) at least about sixty percent by weight refined particulate coal having a pyritic sulfur content, wherein said pyritic sulfur content is less than about one percent by weight of said coal;

(b) a sulfur sorbent comprising a calcium and a magnesium component, wherein said calcium component includes material selected from the group consisting of lime, limestone, hydrated lime, dolomite, burnt dolomite, pressure hydrated burnt dolomite, and mixtures thereof, and wherein said sulfur sorbent is present in an amount sufficient to provide a calcium to total sulfur content molar ratio of at least about 1;

(c) a sulfation promoter present in amounts equal to at least about one percent by weight of said sulfur sorbent, wherein said sulfation promoter comprises material selected from the group consisting of $Cr_2O_3$, $Na_2CO_3$, $NaHCO_3$, $K_2CO_3$, $Li_2CO_3$, $Na_2SO_4$, $MoO_3$, $V_2O_5$, $TiO_2$, Pt, $P_2O_5$, NaCl, $KHCO_3$, $K_2SO_4$ and mixtures thereof; and (d) a catalyst for converting sulfur dioxide to sulfur trioxide in an amount effective to increase sulfur oxides reduction by said magnesium component of said sorbent, wherein said catalyst comprises material selected from the group consisting of platinum, nickel sulfate, cobalt sulfate, vanadium oxides, tungsten oxides, chromium oxides, molybdenum oxides, iron oxides, and mixtures thereof.

19. A fuel composition, as claimed in claim 18, said composition further comprising a binder and wherein said composition is agglomerated.

20. A fuel composition, as claimed in claim 18, said composition further comprising carbonaceous material selected from the group consisting of residual petroleum bottoms, oil, bitumen, kerogen, and mixtures thereof.

21. A fuel composition, as claimed in claim 18, wherein an ash content of said refined coal is less than about five percent by weight of said refined coal.

* * * * *

UNITED STATES PATENT AND TRADEMARK OFFICE

CERTIFICATE OF CORRECTION

PATENT NO. : 4,824,441

DATED : April 25, 1989

INVENTOR(S) : James K. Kindig

It is certified that error appears in the above—identified patent and that said Letters Patent is hereby corrected as shown below:

Column 3, line 6, delete "$S_2/NO_x$" and insert --$SO_2/NO_x$-- therefor.

Column 3, line 63, delete "oorbents" and insert --sorbents-- therefor.

Column 6, line 49, delete "automatccally" and insert--automatically-- therefor.

Column 7, line 63, delete "Additional" and insert--Additionally,-- therefor.

Column 8, line 3, delete "occuring" and insert --occurring-- therefor.

Column 8, line 6, insert after the word "formation" --beyond--

Column 8, line 8, delete "of elements" and insert --elements of-- therefor.

Column 8, line 9, insert after the words "in the"--composition--

Column 8, line 14, delete "compositio" and insert--composition-- therefor.

Column 8, line 45, delete "($CaCO_s$)" and insert --($CaCO_3$)-- therefor.

Column 8, line 45, delete "Oxide" and insert --oxide-- therefor.

UNITED STATES PATENT AND TRADEMARK OFFICE

CERTIFICATE OF CORRECTION

PATENT NO. : 4,824,441

DATED : April 25, 1989

INVENTOR(S) : James K. Kindig

It is certified that error appears in the above—identified patent and that said Letters Patent is hereby corrected as shown below:

Column 8, line 51, delete "a 1600°" and insert --above 1600°-- therefor.

Column 8, line 60, delete "supra" and insert --<u>supra</u>-- therefor.

Column 8, line 67, insert after the words "sulfur dioxide and" --oxygen can--

Column 9, line 22, insert after the words "calcination reactions" --are--

Column 9, line 46, insert after the words "identified by this" --invention--

Column 10, line 7, delete "miling" and insert --mixing-- therefor.

Column 10, line 36, delete "in" and insert --an-- therefor.

Column 10, line 38, delete "which" and insert --with-- therefor.

Column 11, line 9, delete "adoressed" and insert --addressed-- therefor.

Column 11, line 36, before the word "detrimental", delete "an" and insert --any-- therefor.

Column 11, line 45, delete "refinec" and insert --refined-- therefor.

UNITED STATES PATENT AND TRADEMARK OFFICE

CERTIFICATE OF CORRECTION

PATENT NO. : 4,824,441

DATED : April 25, 1989

INVENTOR(S) : James K. Kindig

It is certified that error appears in the above—identified patent and that said Letters Patent is hereby corrected as shown below:

Column 11, line 56, delete "is" after the words "sulfur sorbents" and insert --as-- therefor.

Column 12, line 6, delete "amount" and insert --amounts-- therefor.

Column 12, line 7, delete "compere" and insert --compete-- therefor.

Column 12, line 17, delete "coil" and insert --coal-- therefor.

Column 12, line 37, delete "preeent" and insert --present-- therefor.

Column 12, line 41, delete "torming" and insert --forming materials-- therefor.

Column 12, line 46, delete "benefical" and insert--beneficial-- therefor.

UNITED STATES PATENT AND TRADEMARK OFFICE

CERTIFICATE OF CORRECTION

PATENT NO. : 4,824,441

DATED : April 25, 1989

INVENTOR(S) : James K. Kindig

It is certified that error appears in the above-identified patent and that said Letters Patent is hereby corrected as shown below:

Column 12, line 63, equation (6), delete "$+SO_2 \frac{1}{2} O_2 \rightarrow$" and insert --$+SO_2 + \frac{1}{2} O_2 \rightarrow$-- therefor.

Signed and Sealed this

Seventh Day of May, 1991

*Attest:*

HARRY F. MANBECK, JR.

*Attesting Officer*

*Commissioner of Patents and Trademarks*